United States Patent [19]

Davis et al.

[11] Patent Number: 4,859,105

[45] Date of Patent: Aug. 22, 1989

[54] APPLICATOR BOTTLE

[76] Inventors: Richard E. Davis, 1010 W. 56th St., Kansas City, Mo. 64113; Kathryn J. Fuchs, 5625 W. 97th St., Overland Park, Kans. 66207

[21] Appl. No.: 205,605

[22] Filed: Jun. 10, 1988

Related U.S. Application Data

[63] Continuation of Ser. No. 944,000, Dec. 22, 1986, abandoned.

[51] Int. Cl.[4] ..... A46B 11/00

[52] U.S. Cl. ..... 401/286; 401/131; 132/112; 132/115; 132/124

[58] Field of Search ..... 401/131, 286, 291

[56] References Cited

U.S. PATENT DOCUMENTS

| | | | |
|---|---|---|---|
| 98,257 | 12/1869 | Harris . | |
| D. 165,109 | 11/1951 | Petrosky . | |
| D. 186,350 | 10/1959 | Lerner et al. . | |
| D. 266,537 | 10/1982 | Kahn . | |
| D. 266,538 | 10/1982 | Kahn . | |
| D. 276,480 | 11/1984 | Nigro . | |
| D. 278,951 | 5/1985 | Kalinsky . | |
| 514,290 | 2/1894 | Symonds . | |
| 598,891 | 2/1898 | Barnekov . | |
| 663,245 | 12/1900 | Sturgis . | |
| 732,936 | 7/1903 | Graeme . | |
| 1,084,974 | 1/1914 | Steine . | |
| 1,595,324 | 8/1926 | Van Sant . | |
| 1,928,929 | 12/1931 | Craig . | |
| 2,299,295 | 10/1942 | Battle . | |
| 2,446,407 | 8/1948 | Brenner | 141/343 |
| 2,617,431 | 11/1952 | Gaspari . | |
| 2,618,275 | 11/1952 | Pearson | 132/148 |
| 2,657,410 | 11/1953 | Stroup | 401/131 |
| 2,669,740 | 2/1954 | Main . | |
| 2,672,875 | 3/1954 | Kovacs . | |
| 2,770,826 | 11/1956 | Curfman . | |
| 2,785,426 | 3/1957 | Grey . | |
| 2,922,425 | 1/1960 | Lerner et al. . | |
| 2,944,273 | 7/1960 | Harris . | |
| 3,107,388 | 10/1963 | Groves | 401/183 |
| 3,378,331 | 4/1968 | Beasley . | |
| 3,501,243 | 3/1970 | Heiskell et al. | 401/131 |
| 3,960,160 | 6/1976 | Hogan | 132/112 |
| 4,399,827 | 8/1983 | Fuhs | 401/286 X |
| 4,592,376 | 6/1986 | Sigmund et al. . | |
| 4,652,162 | 3/1987 | Ladd, Jr. et al. . | |

FOREIGN PATENT DOCUMENTS

| | | |
|---|---|---|
| 0521993 | 6/1940 | United Kingdom . |

*Primary Examiner*—Richard J. Apley
*Assistant Examiner*—Franklin L. Gubernick
*Attorney, Agent, or Firm*—Banner, Birch, McKie & Beckett

[57] ABSTRACT

There is disclosed a squeeze-type bottle for dispensing hair-tinting solution having a threaded cap with an applicator brush to which solution is directed through a slot in the cap and a hair spreader extending co-axially of the bottle from the base thereof, the bottle being supported in a vertical position by a base on which the bottle rests with the hair spreader suspended in the base and which also functions as a funnel for filling the bottle.

1 Claim, 1 Drawing Sheet

APPLICATOR BOTTLE

This application is a continuation of application Ser. No. 06/944,000, filed Dec. 22, 1986 now abandoned.

BACKGROUND OF THE INVENTION

This invention relates to an applicator for dispensing solutions such as hair tinting solutions and for applying the solutions in a hair tinting operation.

The numerous applicators disclosed in the prior art include for example the device shown in U.S. Pat. No. 4,399,827 which shows a squeeze-type bottle from which the solution is forced when the bottle is compressed and deformed. The bottle includes a cap threaded on the container and having a brush applicator as well as a spike-like hair spreader or rat-tail both of which are formed with ducts for dispensing solution. A similar arrangement is shown in Des. Pat. No. 266,537 in which a brush and a hair spreader are formed on the cap of a squeeze-type bottle but in which the duct in the cap is open only into the brush and not into the hair spreader.

A hair spreader on the cap of a squeeze-type bottle is not always the most convenient arrangement for its use. The hair spreader extends laterally from the bottle which in effect serves as the handle for holding and manipulating the hair spreader so the bottle must be turned in order to position the hair spreader in the hand for easier use or it must be manipulated awkwardly. At the same time, since the hair spreader is arranged laterally on the cap, forces on it tend to twist the cap and can loosen it if it was not well tightened. Using a hair spreader mounted on the cap with the brush applicator also inherently requires that the bottle be tipped in a manner that tends to pour solution out the duct onto the brush when the hair spreader is used.

The primary object of this invention is to provide an applicator in which the hair spreader is easier to use and which reduces the problems with loose caps and spilling during use of the hair spreader.

SUMMARY OF THE INVENTION

In accordance with this invention, there is provided an applicator for solutions such as hair tinting solutions in which an applicator brush is mounted on the cap and receives solution from the container through openings in the cap and a hair spreader is mounted on the base of the container on which it normally rests. To support the container in an upright manner when it's not in use, there is provided a stand adapted to rest on a supporting surface and upon which the container is adapted to rest with the hair spreader suspended within the stand. The stand tapers from the base to the top which is designed to fit snugly within the mouth of the container whereby the stand also serves as a funnel for filing the container. There is also provided a number of inserts adapted to fit under the cap and having a series of apertures of different sizes which in effect change the size of the opening in the cap to the brush to accommodate solutions of different viscosity.

DESCRIPTION OF THE PREFERRED EMBODIMENT

Figure 1:
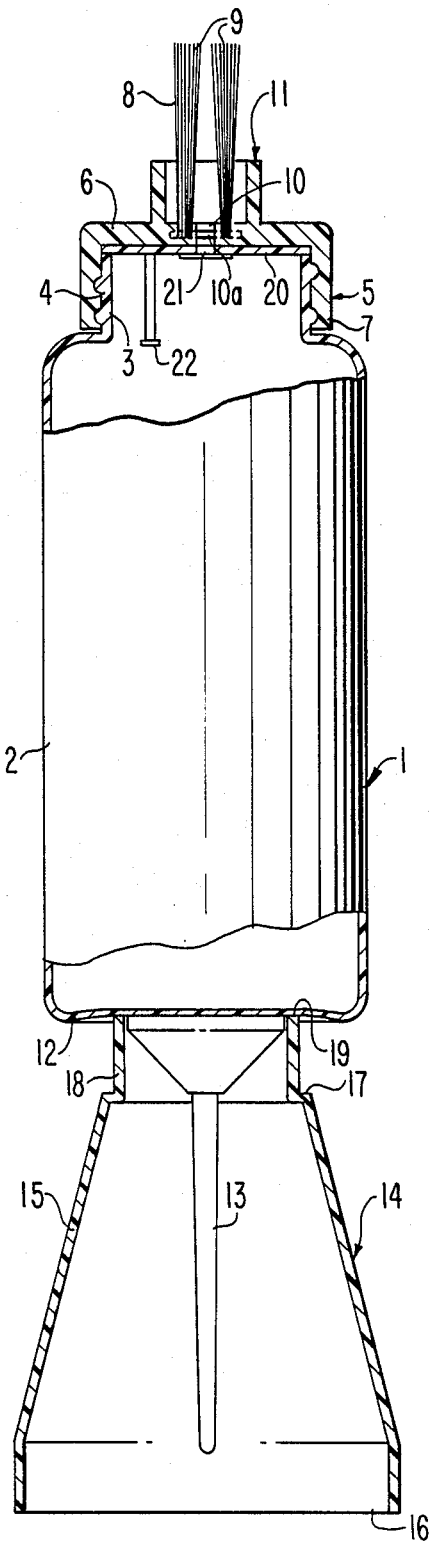
FIG. 1 is an elevational view of a container in accordance with this invention in which the base as well as the cap and the adjacent portion of the container are in section.
Figure 2:
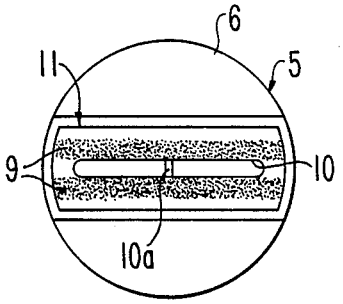
FIG. 2 is a top plan view of the cap of the container of FIG. 1.

With reference to FIG. 1 there is shown a container 1 that is preferably circular but could of course be, for example, elliptical in cross section and formed of a plastic material that is deformable. It may also be transparent so that the solution therein can be more readily identified. The container is designed primarily as a reusable squeeze bottle for use in dispensing hair-tinting solutions in hair treating operations.

The container 1 has a side wall 2 with a mouth 3 at the top thereof defined by an externally threaded neck 4 of reduced diameter from the side wall 2. A cap 5 comprising a top wall 6 and an internally threaded cylindrical side wall 7 is adapted to be threaded into the neck 3.

Mounted on the top wall 6 of the cap 5 is a brush 8 that consists of two rows of bristles 9 embedded at one end in and extending upwardly from the top wall 6 of the cap 5 along opposite sides of a slot 10 through the top wall and arranged diametrically thereof with a supporting rib or wire 10*a* extending between the side walls of the slot 10 at the middle longitudinally of the slot. When the container 1 is inverted and compressed, solution therein is adapted to be forced out the slot 10 onto the brush 8 between and at the base of the two rows of bristles 9.

A continuous band or wall 11 is formed on and upstanding from the top wall 6 of the cap 5 surrounding and spaced from the base of the two rows of bristles 9. The wall 11 serves to confine the solution forced through the opening 10 and to direct it into the bristles 9. At the same time, the wall 11 defines a reservoir for collecting solution draining from the bristles 9 when the container is arranged upright as seen in FIG. 1.

Extending longitudinally of the container 1 from the bottom wall 12 thereof, and more particularly, extending co-axially thereof, is a spike-like hair separator or rat-tail 13. There is also provided a hollow base or stand 14 that is generally frustro-conical in shape and includes a side wall 15 that is open at both the top and the bottom. The side wall 15 tapers inwardly from a bottom edge 16 that is adapted to rest on a supporting surface to a shoulder 17 that is smaller in diameter than the container 1.

Rising from the shoulder 17 is a cylindrical neck 18 that has an outside diameter that is only slightly less than the inside diameter of neck 4 of the container 1 and is adapted to fit snugly into the mouth 3 whereby the stand 14 will serve as a funnel for filing the container. The neck 18 terminates in a top edge 19 on which the bottom wall 12 of the container 1 is adapted to be seated. The stand 14 is high enough so that when the container 1 is seated on the top edge 19 as shown in FIG. 1, the hair separator 13 is suspended within the stand.

Inside the cap 5 is a disk 20 that is clamped between the upper edge of the neck 4 and the top wall 6 of the cap when the cap is threaded on the container 1. The disk 20 is provided with a series of holes 1 adapted to meter the solution from the container to the slot 10 in the cap. The disk 20 has a slight interference fit relative to the cap 5 so that it will be frictionally retained in place and has means such as the stud 22 that can be grasped for removing it from the cap. The disk 20 is also cut away as shown at 23 to receive a mating projection 24 molded on the inside of the cap 5, which serves to position the disk with the holes 21 aligned with the slot 10 and to prevent the disk 20 from turning as the cap is screwed down.

Figure 3:
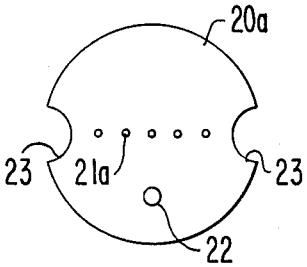
FIGS. 3 and 4 are plan views of inserts with different size apertures.
Figure 4:
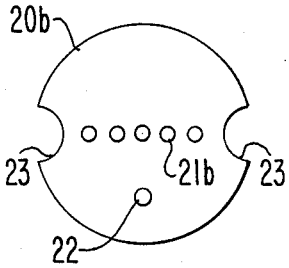
Figure 5:
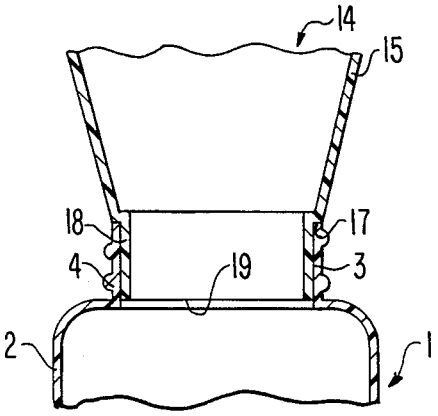
FIG. 5 is a fragmentary sectional view of the mouth of the container with the top of the base inserted therein wherein the base serves as a funnel for filling the container.

For solutions of different vicosities, a number of the disks may be provided with different size apertures such as the disks 20*a* and 20*b* with the apertures 21*a* and 21*b* respectively shown in FIGS. 3 and 4.

Modifications from the design of the preferred embodiment herein disclosed will of course be obvious to those skilled in the art.

We claim:

1. A device for applying hair treating solution or the like comprising a container having a reduced neck defining a mouth at one end and a bottom wall at the other end, a cap adapted to close said mouth and having an opening through the top wall thereof and brush means secured thereto on opposite sides of said opening, a hair spreader secured to said bottom wall of said container opposite from said neck and extending longitudinally of the container, and a hollow stand open at the top and having a length greater than the length of said hair spreader, said stand having a transverse dimension at said top that is smaller than the transverse dimension of said bottom wall of said container whereby the container will rest on the top of said stand with the hair spreader suspended in said stand and having a transverse dimension at the end opposite from said top sufficient to provide a base for resting said stand on a supporting surface while supporting said container, said stand having a neck at said stop with an outside dimension smaller than the internal dimension of the mouth of said container whereby said neck of said stand is adapted to be inserted into said mouth when the stand is inverted and to function as a funnel for filling said container.

* * * * *

UNITED STATES PATENT AND TRADEMARK OFFICE

CERTIFICATE OF CORRECTION

PATENT NO. : 4,859,105

DATED : August 22, 1989

INVENTOR(S) : Richard E. Davis and Kathryn J. Fuchs

It is certified that error appears in the above-identified patent and that said Letters Patent is hereby corrected as shown below:

Column 1, line 19, "266,537" should be --266,538--; and

Column 3, line 1, "1" should be —21—.

Signed and Sealed this

Thirty-first Day of July, 1990

*Attest:*

*Attesting Officer*

HARRY F. MANBECK, JR.

*Commissioner of Patents and Trademarks*